United States Patent [19]

Thompson

[11] Patent Number: 4,962,722

[45] Date of Patent: Oct. 16, 1990

[54] ADJUSTABLE PROTECTION SHIELD FOR PREVENTING COATING OVERSPRAY ON A BUILDING'S SURFACE

[76] Inventor: Darrow D. Thompson, 3590 Colony Ct., Placerville, Calif. 95667

[21] Appl. No.: 379,082

[22] Filed: Jul. 13, 1989

[51] Int. Cl.[5] ..... B05C 21/00

[52] U.S. Cl. ..... 118/504

[58] Field of Search ..... 118/504, 505, 301; 427/282; 29/402.18; 248/111

[56] References Cited

U.S. PATENT DOCUMENTS

| | | | |
|---|---|---|---|
| 1,156,195 | 10/1915 | Wieser | 118/504 X |
| 2,361,303 | 10/1944 | MacDonell | 248/111 |
| 2,484,607 | 10/1949 | Cherem | 118/504 |
| 3,942,472 | 3/1976 | McAlister | 118/504 |
| 4,085,703 | 4/1978 | Glowacki | 118/504 |
| 4,241,693 | 12/1980 | Shotwell | 118/504 |
| 4,383,496 | 5/1983 | Shotwell | 118/504 |
| 4,574,731 | 3/1986 | Stevens et al. | 118/504 |
| 4,697,544 | 10/1987 | Stevens et al. | 118/504 |

FOREIGN PATENT DOCUMENTS

| | | | |
|---|---|---|---|
| 1058568 | 7/1979 | Canada | 118/504 |

*Primary Examiner*—Richard L. Chiesa

*Attorney, Agent, or Firm*—James M. Ritchey

[57] ABSTRACT

An adjustable protection shield for preventing a non-designated area of a building's surface from being accidentally covered with a coating material is disclosed whereby a protection blade is secured in an adjustable blade holder. The adjustable blade holder has a first hinge component having a blade anchoring member for accepting the protection blade and a first hinge mate member projecting from the blade anchoring member. A second hinge component of the blade holder, comprising a handle/extension handle attachment member and a second hinge mate member, is adjustably connected to the first hinge component by contacting a mating surface on each of the hinge mate members and securing at a desired angular position with a hinge fastening means.

2 Claims, 1 Drawing Sheet

FIG. - 1
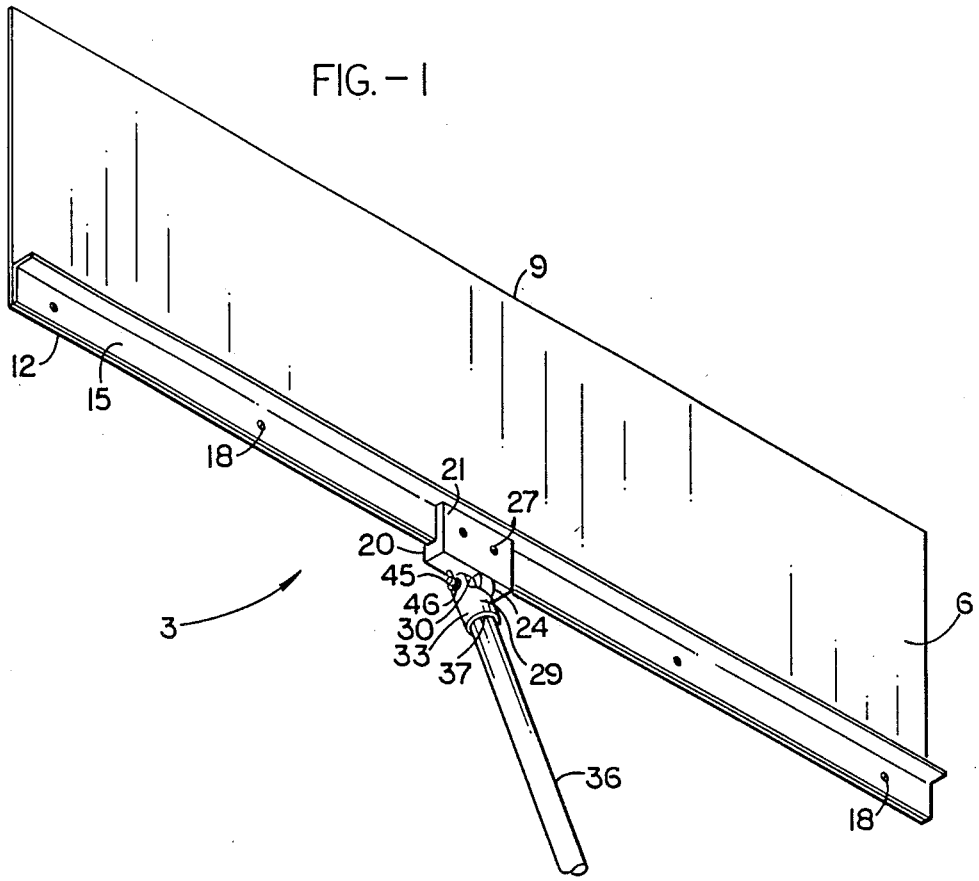
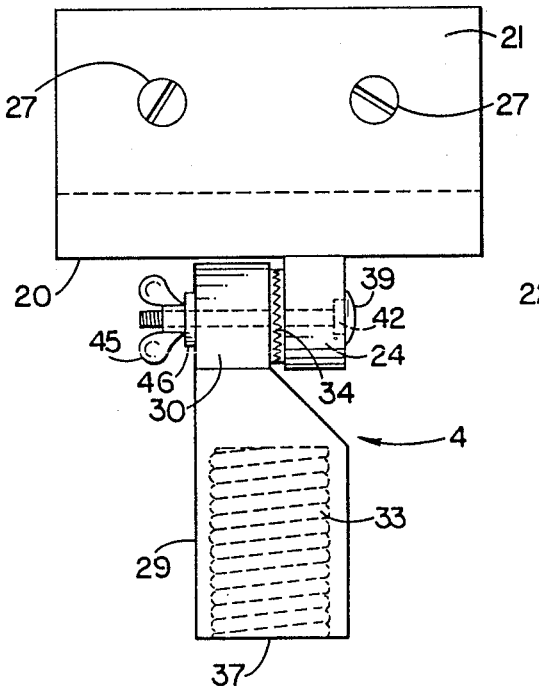
FIG. - 2
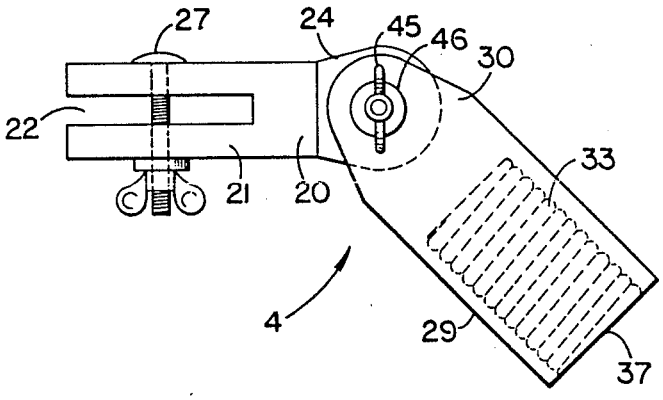
FIG. - 3

ADJUSTABLE PROTECTION SHIELD FOR PREVENTING COATING OVERSPRAY ON A BUILDING'S SURFACE

BACKGROUND OF THE INVENTION

1. Field of the Invention

A device for protecting a selected area of a building's exterior or interior surface from becoming covered with an undesirable coating material is disclosed. More particularly, the present invention relates to an adjustable protection shield device having a novel construction including an adjustable blade holder for accepting and reversibly securing a protection blade. The adjustable blade holder has a first hinge component comprising a generally flattened blade anchoring member and a first hinge mate member. A second hinge component comprising a handle/extension handle attachment member and a second hinge mate member is adjustably connected to the first hinge component via a hinge fastening means that secures mated non-slip surfaces on the first and second hinge mate members.

2. Description of the Background Art

During the application of paint, sealant, texturizing compound, or similar materials by standard techniques to construction surfaces (such as walls, ceilings, and equivalent areas), non-designated regions or areas need to be protected from overspray, splatters, or like contamination. Traditional methods of protecting a building's exterior or interior surfaces from undesired coating materials were taping or laying sheets of paper, cloth, or plastic to a particular area not to be coated or using a rigid, non-adjustable protection shield that would be slid to a required position. For a user, like a homeowner or do-it-yourself person, who occasionally applies coatings to a building these traditional techniques are time-consuming, but possibly tolerable, given the lack of suitable protection substitutes. However, for professional painters and similar artisans these time consuming protection techniques were not cost effective.

Rigid, non-adjustable type protection shields are quicker to employ than the taping or laying procedures, but depending upon the area to be protected the craftsman had only a limited number of shield versions from which to select (primarily a flat model or a fixed angle type) and depending upon the structure's surface requirements (such as straight or angled wall to wall, wall to ceiling, or similar surface joining features) time would be needed to put down one shield version and take up another. Further, for a shield to be useful (to prevent overspray, seepage, or like contamination of undesired coating materials onto the protected surface) its protecting edge or edges must be maintained in a non-damaged condition. Therefore, if damage occurs to the blade edge of a non-interchangeable protection device the entire device would be discarded. The subject invention overcomes these problems and others, obvious to one skilled in the relevant art, by providing an adjustable protection device that; the user may readily position to any desired angle, has interchangeable blades, and is adapted for direct use with an incorporated handle or by use with an extension handle.

SUMMARY OF THE INVENTION

An object of the present invention is to produce a versatile and maneuverable protective shield device to prevent the accidental misapplication of coating materials to building surfaces that are not designated to be covered with a particular coating.

Another object of the present invention is to provide an easily adjustable protection shield device that allows the user to position a protection blade at a desired angle to accommodate protecting structural features of a building's surface.

A further object of the present invention is to construct a protection shield device that permits the user to readily exchange a new protection blade for an old non-functional protection blade.

Yet another object of the present invention is to provide an adjustable protection shield device that allows the user to employ the device directly or with an extension handle to reach a remote location.

Still an additional object of the present invention is to furnish an adjustable shield device and associated adjustable blade holder that are light in weight and inexpensive to produce.

The subject invention, an adjustable protection shield for preventing a non-designated area of a building's surface from being accidentally covered with a coating material, comprises a protection blade that is secured in an adjustable blade holder. The adjustable blade holder comprises a first hinge component having a generally flattened blade anchoring member, with upper and lower surfaces and perimeter edges, adapted for accepting and reversibly securing the protection blade and a first hinge mate member projecting from an edge of the blade anchoring member. A second hinge component of the blade holder, comprising a handle/extension handle attachment member that extends into a second hinge mate member, is adjustably connected to the first hinge component. The adjustable connection between the first and second hinge components is made by contacting a mating surface on each of the hinge mate members and securing at a desired angular position with an hinge fastening means.

Other objects, advantages, and novel features of the present invention will become apparent from the detailed description that follows, when considered in conjunction with the associated drawings.

BRIEF DESCRIPTION OF THE DRAWINGS

FIG. 1 is a perspective of the adjustable protection shield device.

FIG. 2 is a top view of the adjustable blade holder.

FIG. 3 is a side view of the adjustable blade holder.

DESCRIPTION OF THE PREFERRED EMBODIMENT

Referring now to FIGS. 1–3, there is shown a preferred embodiment of an adjustable protection shield device 3 and associated adjustable blade holder 4 of the subject invention. This device is for protecting a building's wall, ceiling, or equivalent surface from overspray, splattering, or like occurrence during the application of a coating, such as paint, sealant, texturizer compound, or similar materials, to a desired area. Therefore, the subject device prevents a coating material from being applied to a non-designated surface area of a structure.

The subject adjustable protective shield device 3, as illustrated in particular in FIG. 1, comprises an adjustable blade holder 4, clearly drawn in FIGS. 2 and 3, fitted with a protection blade 6. The protection blade is generally a thin rectangular sheet of suitable material having a leading edge 9 and a rear attachment edge 12. The leading edge 9 would be pressed against the area to be protected against unwanted coating materials. The rear attachment edge 12 of the protection blade provides an attachment point for coupling to the adjustable blade holder 4.

Suitable materials for fabricating the protection blade 6 would be light weight substances such as polymer plastics and rubbers, metals, woods, and like substances, preferably a semirigid plastic or nylon that is easy to cut and drill, yet reasonably resistant to normal wear experienced during rapid movement from one surface area to another. Although the shape of the protection blade 6 is depicted in its preferred rectangular form in FIG. 1, other shapes are contemplated by this disclosure for specific surface protection purposes and include square, circular, triangular, and similar forms.

An optional, but preferred element of the protection shield device 3 is a blade-guard 15 running approximately coextensively with length of the rear attachment edge 12, as seen in FIG. 1. The blade-guard 15 serves a multiple role of adding rigidity to the rear attachment edge 12 of the blade 6 and helping to deflect coating materials from running down the blade holder 4 or dripping on the user. The blade-guard 15 is connected to the blade 6 proximate its rear attachment edge 12 by reversible attachment means, preferably blade/blade-guard fasteners 18 such as screws or bolts and nuts, but more permanent attachment means are contemplated such as rivets, welds, adhesives, and equivalents. The structure of the blade-guard 15 is depicted in FIG. 1 as having a L-shaped form, however, angles other than ninety degrees are considered to be acceptable. Further, the blade-guard 15 may wrap around the blade's rear attachment edge 12 and side edges to aid in securing and structurally stabilizing the blade 6. Additionally, the blade-guard 15 may form a pocket for receiving the rear attachment edge 12 of the blade 6 and be connected to the blade 6 by blade/blade-guard fasteners 18 or by equivalent attachment means. While the selection of the matter comprising the blade-guard 15 is well within the teaching of the art, materials such as aluminum, synthetic polymers, rubbers, wood, and like substances are desirable.

The adjustable blade holder 4 functions not only to receive and reversibly secure the protection blade 6, but to provide a hinge point for angling the blade 6 to any desired position and as a handle for a user or as an extension handle attachment location. As illustrated in FIGS. 2 and 3, the blade holder 4 comprises a first hinge component 20 having a blade anchoring member 21 with a blade receiving slot 22 and an adjustable first hinge mate member 24. The blade anchoring member 21 is generally a flattened rectangular body or block with upper and lower surfaces and perimeter edges. Associated with the perimeter edges of the blade anchoring member 21 are the blade receiving slot 22, for receiving the blade 6 and preferably the blade-guard 15, and the adjustable first hinge mate member 24. For a blade anchoring member 21 that is approximately a rectangular block, the blade receiving slot 22 and the first hinge mate member are on opposing edges of the blade anchoring member 21. Even though the preferred shape of the blade anchoring member 21 is a flattened rectangular body, other equivalent shapes, either flattened or not, are contemplated by this disclosure such as square, round, elliptical, triangular, or like forms. The blade receiving slot 22 is of appropriate dimensions for receiving the blade 6 and usually blade-guard 15.

To allow a user to exchange one blade 6 for another, reversible attachment means 27 are employed to secure the blade 6 and blade-guard 15 within the blade receiving slot 22. As seen in FIGS. 2 and 3, the preferred reversible attachment means 27 is a bolt and nut combination, but equivalent structures are well within the scope of this disclosure. Further, FIG. 2 shows the bolt head of the attachment means 27 as having a slot for a screw driver, but this is not critical and a carriage bolt with a countersunk hole in the blade anchoring member 21 is acceptable, as would other similar attachment procedures. Likewise, FIG. 3 indicates the attachment means 27 has a wing nut for reversibly securing the bolt, but other equivalent means are contemplated as being adequate.

Projecting from one edge of the blade anchoring member 21 is the adjustable first hinge mate member 24. As FIGS. 2 and 3 display, the first hinge mate member 24 is preferably a flattened, nearly circular body connected by one portion of the perimeter edge to the blade anchoring member 24. The circular body has a perimeter edge and two opposing approximately circular surface faces, one an outer face and one an inner mating face, with each face running perpendicular to the upper and lower surfaces of the blade anchoring member 21. Other non-circular shapes of equivalent function are considered to be within this disclosure. Normally the blade anchoring member 21 and the first hinge mate member 24, together comprising the adjustable blade holder 4, are manufactured as one integral part from metal (such as aluminum or light alloys), polymers (like plastics, hard rubbers, nylon, and the like), or equivalent substances. Although FIG. 2 shows the first hinge mate member 24 as projecting from one edge of the blade anchoring member 21 at a location slightly offset from the midline of the blade anchoring member 21, this is for balance only and may be altered to accommodate a special shielding purpose.

A hole, completely penetrating (from the outer surface face to the mating surface face) the first hinge mate member 24, is located near the center of the nearly circular first hinge mate member 24. This hole runs approximately parallel with the rear attachment edge 12 of the blade 6. The hole serves as a channel for a hinge pin that adjustably connect a second hinge component 29 to the first hinge component 20 by contacting a mating surface on each hinge mate member.

The second hinge component 29 comprises an adjustable second hinge mate member 30 and a handle/extension handle attachment member 33. The adjustable second hinge mate member 30, as seen in FIGS. 2 and 3, has a partially circular perimeter and is an extension of the handle/extension handle attachment 33. Usually, the second hinge component 29 is fabricated as one continuous body from the same material employed to produce the first hinge component 20. Like the first hinge mate member 24, the second hinge mate member has opposing surface faces, one an outer surface face and the other an inner mating surface face. Normally, the outer of these opposing surface faces, but not critically, extends in a smooth approximately planar transition from the curved surface of the preferably cylindrical handle/extension handle attachment member 33, while the other surface face of the second hinge mate member 30 presents an inset mating surface (inset from the cylindrical handle/extension handle attachment member 33 surface) for contacting with the mating surface face on the first hinge mate member 24 to produce a contact region 34. Further, as with the first hinge mating member, a hole completely penetrates the second hinge mating member proximate the center of partial circular portion, running approximately parallel with the rear attachment edge 12 of the blade 6.

In order to prevent undesirable rotational movement of the hinge, each mating surface, one on each hinge mating member, 20 and 29, usually incorporates a non-slip coating, texture, or integral surface structure. As illustrated in FIG. 2, the contact region 34 has meshing teeth from each mating face to prevent rotational slippage. These sets of teeth have each crest and trough directed radially outward from the penetrating hole and resist a change is a secured angular position between the first and second hinge mate members 24 and 30. Other equivalent substitutes to replace interacting sets of teeth are well within the scope of this disclosure and include, but are not limited to, tacky, rubberized, roughened, and similarly treated surfaces or non-slip gaskets and washers.

As stated above, the handle/extension handle attachment member 33 is usually cylindrical (but may be suitably contoured) and may be of any suitable length so as to serve directly as a user handle or as a point of attachment for an extension handle 36 that is secured into the handle/extension handle attachment member 33 by means of an attachment mechanism such as the threaded opening 37 within the handle/extension handle attachment member 33.

To connect the first and second hinge components to produce a functioning adjustable hinge, a hinge fastener pin or preferably a hinge fastener bolt 39 (carriage or the like) runs from the first hinge mate member 24 through the second hinge mate member 30. A carriage bolt 39 may be secured against turning within the hole in the first hinge mating member by appropriate means such as the depicted countersunk recess 42, by a screw driver slot in the bolt head, or equivalent manner. Also, the bolt 39 may be directly incorporated into the first hinge mating member 24 so that such a member would present a structural integral protruding threaded bolt to fit within the matching hole in the second hinge mating member 30. A simple reversal of this fastening procedure is well within the skill of an artisan in this or related fields.

Given the preferred embodiment of the subject invention drawn in FIGS. 1–3, the hinge fastener bolt 39 is secured by a hinge fastener nut 45 and optionally a washer 46. For ease of use, a wing-nut 45 is depicted, but a standard type of nut is acceptable. Other equivalent adjustable means besides a bolt and nut may be employed to secure the hinge mating members and would be apparent to those skilled in the art and include, but are not limited to, spring activated devices, lever or twist clamps, and like mechanisms.

To employ the adjustable protection device 3 and associated adjustable blade holder 4 the user merely determines the condition of the blade 6 and if damaged or not suitable for any other reason replaces the blade 6 (and possibly blade-guard 15, if present) with another. Once the subject device has an acceptable blade 6, the user loosens the hinge fastener bolt 39 and nut 45 and adjusts by rotating the hinge components to a desired angle. After selecting the angle, the hinge is locked tight. Either the handle/extension handle attachment member 33 is directly employed as a handle or an extension handle 36 is attached. The user places the shield to cover the surface to be protected and applies the selected coating to the region beyond and next to the leading edge 9 of the protection blade 6.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. An adjustable blade holder for use with a protection shield device employed for preventing a coating material from being applied to a non-designated surface area of a structure, comprising:

(a) a first hinge component having a blade anchoring member for reversibly securing a protection blade and a first hinge mate member projecting from said blade anchoring member and (b) a second hinge component comprising a handle/extension handle attachment member, for holding by a user and reversibly attaching an extension handle, that extends into a second hinge mate member, wherein said first hinge component and said second hinge component are adjustably connected by contacting a mating surface on each of said first and said second hinge mate members and securing at a desired angular position with a hinge fastening means, wherein said hinge fastening means is a hinge fastener bolt running from said first hinge mate member and through said second hinge mate member and secured by a hinge fastener nut and each of said mating surfaces of said first and said second hinge mate members is a non-slip surface which resists a change in said secured angular position, wherein said non-slip surface comprises a set of teeth with each crest and trough directed radially outward from said hinge fastener bolt.

2. An adjustable protection shield device for preventing a coating material from being applied to a non-designated surface area of a structure, comprising:

(a) a protection blade;

(b) a first hinge component comprising a generally flattened blade anchoring member, with upper and lower surfaces and perimeter edges, for reversibly securing said protection blade and a first hinge mate member projecting from one said edge of said blade anchoring member; and (c) a second hinge component comprising a handle/extension handle attachment member, for holding by a user and reversibly attaching an extension handle, that extends into a second hinge mate member, wherein said first hinge component and said second hinge component are adjustably connected by contacting a mating surface on each of said first and said second hinge mate members and securing at a desired angular position with a hinge fastening means, wherein said hinge fastening means is a hinge fastener bolt running from said first hinge mate member and through said second hinge mate member and secured by a hinge fastener nut and each of said mating surfaces of said first and said second hinge mate members is a non-slip surface which resists a change in said secured angular position, wherein said non-slip surface comprises a set of teeth with each crest and trough directed radially outward from said hinge fastener bolt.

* * * * *